United States Patent [19]

Lodovico

[11] Patent Number: 4,703,899

[45] Date of Patent: Nov. 3, 1987

[54] FEEDING DEVICE FOR A CONTAINER CUTTING MACHINE

[75] Inventor: Frank J. Lodovico, Delmont, Pa.

[73] Assignee: John W. Wagner, Murrysville, Pa.

[21] Appl. No.: 909,897

[22] Filed: Sep. 22, 1986

[51] Int. Cl.[4] ..... B02C 19/14

[52] U.S. Cl. ..... 241/99; 241/225; 241/236

[58] Field of Search ..... 241/99, 236, 166, 167, 241/36, 37.5, 224, 222, 225; 100/902, 96, 172; 194/208, 209; 83/500–504, 345

[56] References Cited

U.S. PATENT DOCUMENTS

| | | | |
|---|---|---|---|
| 3,951,059 | 4/1976 | Morris | 241/99 X |
| 4,009,838 | 3/1977 | Tashman | 241/236 X |
| 4,134,556 | 1/1979 | Ehrlich et al. | 241/236 X |

FOREIGN PATENT DOCUMENTS

| | | | |
|---|---|---|---|
| 136597 | 10/1980 | Japan | 241/236 |

*Primary Examiner*—Mark Rosenbaum
*Attorney, Agent, or Firm*—James L. Sherman

[57] ABSTRACT

An improved container feeding device is for a container cutting machine of the type which can cut any one of numerous sizes of plastic bottles and metal cans. The cutting machine has a cutting section including a plurality of cutting wheels mounted for rotation in opposite directions on a pair of parallel cutting shafts. The improvement includes a pair of parallel feeding shafts each of which are above one of the cutting shafts for rotation in the same direction thereof. Each feeding shaft includes three radially extending, evenly spaced paddles fixedly mounted thereon. The feeding shafts rotate at the same speed and are rotationally aligned to cause each paddle on one feeding shaft to generally lie within a common plane with a corresponding paddle on the other feeding shaft as they pass closely by one another. Each of the paddles has a plurality of gripping teeth on the extended end thereof. Each gripping tooth has a tip which extends between the gripping teeth of the other paddle to produce a radial overlap of each paddle with its corresponding paddle when in the common plane. The extended ends of each paddle and its corresponding paddle cooperate during rotation prior to, through and after sharing the common plane to grip the container therebetween for pushing toward the cutting wheels.

15 Claims, 10 Drawing Figures

FEEDING DEVICE FOR A CONTAINER CUTTING MACHINE

BACKGROUND OF THE INVENTION

1. Field of the Invention

This invention relates to an improved container feeding device of the type which is used in a machine capable of cutting any one of numerous sizes of plastic bottles and/or metal cans into small pieces.

2. Description of the Prior Art

Recent legislation regulating the collection and disposition of disposable containers such as plastic bottles and metal cans in the soft drink industry has resulted in increased interest in machines that can be employed to reduce the size of the used containers to simplify handling and storage. Two recently devised machines have been primarily successful in satisfying these objectives.

The first of these machines is of a type which is intended to cut a large number of containers simultaneously and is disclosed in a patent application, U.S. Ser. No. 834,968, entitled "A Machine For Cutting Disposable Containers" and filed by John W. Wagner on Feb. 28, 1986 (a continuation application of U.S. Ser. No. 646,917 filed on Sept. 4, 1984). This machine is intended to be operated by operating personnel at a container collecting facility such as a grocery store or the like. For example, depending on the sizes of the plastic bottles, twenty to forty plastic bottles can be initially loaded in the upper loading section of the machine. When the top of the loading section is closed, the machine can be turned on to cause the bottles to be cut in a centrally located cutting section. The cutting section includes a pair of parallel shafts mounted for rotation in opposite directions with each shaft having a plurality of cutting wheels mounted for rotation thereon. The cutting section causes the containers to be cut into plastic strips or pieces which are then collected at a collecting section therebelow.

To insure that the containers are properly fed to the cutting section, the loading section includes a pair of paddles on a rotating shaft to generally agitate the bottles therein. The funnel shape of the loading section directs the bottles by gravity to a feeding assist device in the entrance opening of the cutting section. The feeding assist device includes a pair of parallel feeding shafts each of which has an array of three paddles thereon for advancing the containers to the cutting wheels to be gripped thereby prior to being specifically cut. With this machine, it is not essential that individual containers be fed and cut in any particular manner. The use of the agitator and feeding assist device is such that as the machine is being operated, all of the containers will eventually be cut. The operator will simply turn off the machine after he believes the last container has been properly cut in the cutting section. However, if one container is not properly oriented, it may be agitated upwardly and downwardly within the loading section or even rotate around with the feeding assist paddles several times prior to actually being cut. Additionally, if a single container or numerous containers which are simultaneously fed to the cutting section were to temporarily overload the cutting section, an automatic reversing device could cause the cutting shafts to rotate in the opposite direction temporarily to prevent the machine from becoming jammed. On the other hand, if after continued agitation or a machine reversal a particular container was still not properly fed for cutting, the machine operator would simply ignore the container and would cause it to be properly cut with the next load of containers placed in the loading section.

Another machine is employed to separately cut individual bottles as they are separately fed to a "reverse vending machine". A reverse vending machine is a machine which is being installed in grocery stores or the like for the customers to directly deposit plastic bottles or metal cans therein. At the same time the machine cuts the container into small pieces to decrease the overall volume of plastic or metal collected therein, the customer receives a token or other redemption of a deposit paid when the soft drink or other beverage is initially purchased. Such a machine is disclosed in patent application U.S. Ser. No. 742,999, filed on June 10, 1985 by Frank J. Lodovico and John W. Wagner and entitled "Method And Apparatus for Cutting Disposable Containers" (a continuation-in-part application of U.S. Ser. No. 646,917 filed Sept. 4, 1984 by John W. Wagner and entitled "A Machine For Cutting Disposable Containers"). Clearly, with such a machine it is essential that the containers can be continuously fed for cutting without any jamming or failure. In fact, to insure that a customer will not deposit a container in the machine prior to proper cutting of the immediately preceeding container, the machine includes sensing devices to determine that each container passes by the entrance for proper cutting in the cutting section. As a result, any failure or delay in cutting could cause complete loss of the machine to subsequent customers wishing to redeem containers until the machine is cleared by store personnel. While the machine of U.S. Ser. No. 742,999 has continued to properly cut all containers which are properly fed to the cutting section, there remains a need for insuring that all of the numerous sizes of plastic bottles or metal cans will be properly accepted and feed to the cutting section without jamming or delay.

SUMMARY OF THE INVENTION

It is, therefore, an object of this invention to provide an improved container feeding device for a container cutting machine which is capable of cutting any one of numerous sizes of plastic bottles and/or metal cans.

It is another objective to provide such an improved container feeding device which is reliable to operate to insure that there are no failures or delays in feeding the containers to the cutting section for cutting into a plurality of pieces.

These and other objects of the invention are provided in a preferred embodiment thereof including an improved container feeding device for a container cutting machine of the type which is capable of cutting any one of numerous sizes of plastic bottles and metal cans. The machine includes a cutting section having a pair of parallel cutting shafts mounted for rotation in opposite directions. Each of the cutting shafts supports a plurality of cutting wheels keyed for rotation therewith. Each of the cutting wheels on one of the cutting shafts is axially separated from axially adjacent cutting wheels thereon by one of the cutting wheels on the other of the cutting shafts extending therebetween. Each cutting wheel has a plurality of cutting teeth thereon. The improvement includes a pair of parallel feeding shafts centrally disposed above the pair of cutting shafts and parallel therewith. The feeding shafts are a predetermined distance apart. Each of the feeding shafts includes three radially extending, evenly spaced paddles fixedly mounted thereon. Each of the feeding shafts and the paddles thereon rotate in the same direction as its adjacent cutting shaft. Each paddle has an extended end including a plurality of gripping teeth. The paddle has a predetermined length from the center of the feeding shaft to a tip of the gripping teeth. The feeding shafts rotate at the same speed and are rotationally aligned to cause each paddle on one feeding shaft to be in a common plane with a corresponding paddle on the other feeding shaft when passing closely thereby. Each paddle on the feeding shaft has the tips of the gripping teeth thereof extending between the gripping teeth of the corresponding paddle on the other feeding shaft to produce a radial overlap of each paddle with the corresponding paddle when in the common plane. The predetermined length of the paddle is greater than one half of the predetermined distance.

DESCRIPTION OF THE PREFERRED EMBODIMENT

Figure 1A:
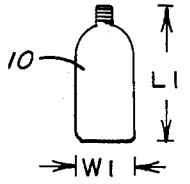
FIGS. 1A through 1D are schematic views of the numerous sizes of plastic bottles currently being utilized to demonstrate the relative dimensions thereof.
Figure 1B:
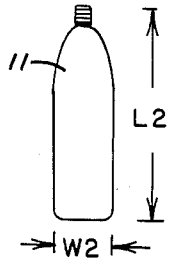
Figure 1C:
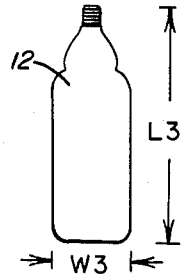
Figure 1D:
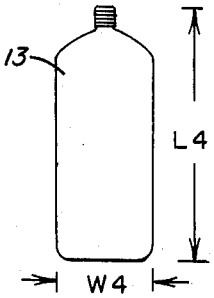

In order to fully understand and appreciate the problems associated with properly feeding containers in a reverse vending machine to the cutting sections thereof, it is important to recognize the wide variety of sizes and shapes of the plastic bottles which must be received in such a machine. As seen in FIGS. 1A through FIGS. 1D, four plastic bottle sizes are presently employed in the soft drink industry to meet the varying demands of customers. The bottle shown in FIG. 1A is a half liter or pint bottle 10 having a length L1 of 7 inches and a width W1 of $2\frac{3}{4}$ inches. The one liter bottle 11 of FIG. 1B has a length L2 of 11 inches and a width W2 of 3 inches. In FIG. 1C, a two liter bottle 12 has a length L3 of 12 inches with a width W3 of $4\frac{1}{2}$ inches. Finally, a three liter bottle 13 of FIG. 1D has a length L4 of 13 inches and a width W4 of 5 inches. While these dimension are only approximate and vary for different bottles of the same size from different manufacturing sources, they do serve as examples of the wide range of sizes and dimensions which may be required to be cut in an acceptable reverse vending machine.

Although no metal cans are specifically shown in the figures, there are also various sizes of cans which might be employed in a reverse vending machine. Generally, it has been found that a reverse vending machine employing the type of cutting sections to be described hereinbelow will accept and cut various sizes of metal cans without any jamming or delay if properly fed thereto. Because of the characteristics of metal as compared to the characteristics of plastic, metal cans can be more readily fed for cutting but any feeding assist device used should alternatively insure proper feeding of the wide variety of plastic bottles and any existing metal cans or metal cans of a future design.

Figure 2:
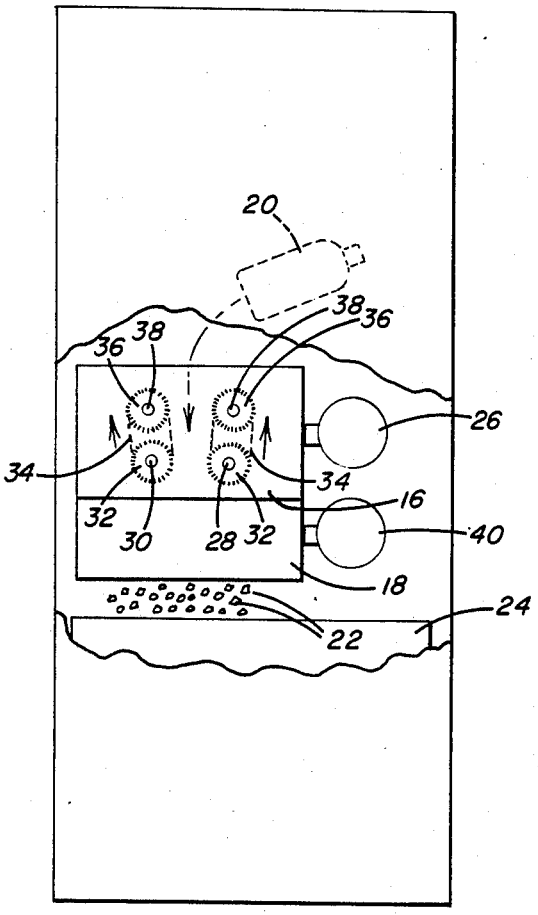
FIG. 2 PRIOR ART
FIG. 2 is a fragmentary schematic view of a prior art reverse vending machine including the cutting sections thereof and the relationship of the typical feeding assist means therefor.

As seen in FIG. 2, a reverse vending machine 14 employs a first cutting section 16 and a second cutting section 18 to cut plastic bottles into small pieces 22 for deposit in a collecting container 24. The first cutting section 16 is similar to the basic cutting section disclosed in the above mentioned U.S. Ser. No. 834,968. A motor 26 of the first cutting section 16 drives one of the cutting shafts 28 which is geared to the other cutting shaft 30 to cause them to simultaneously rotate at the same speed but in opposite directions. The gearing for simultaneous driving of the cutting shafts 28, 30 is not shown in FIG. 2 since it is on the rearward side of the first cutting section 16. The forward end of each of the cutting shafts 28, 30 includes a drive sprocket 32 to drive a chain 34 which encircles a driven sprocket 36 mounted on the end of each of a pair of feeding shafts 38. Although this general configuration will be discussed in detail hereinbelow, the feeding shafts 38 are parallel with each other and with the cutting shafts 28, 30 and rotate in the same direction as their corresponding cutting shaft 28,30.

The combined first cutting section 16 and second cutting section 18 are of the type which is generally disclosed in the above mentioned U.S. Ser. No. 742,999. The second cutting section 18 has its own motor 40 and includes another cutting configuration to further reduce the size of the first elongated pieces (not shown) discharged from the first cutting section 18 in order to obtain the smaller second pieces 22 for collection in the container 24. Although both the first cutting section 16 and second cutting section 18 are significant for the operation of a proper reverse vending machine 14, the detailed operations thereof are not essential to an understanding of the preferred feeding assist means of the present invention.

While the first cutting section 16 and second cutting section 18 can properly cut plastic bottles and/or metal cans, it is essential to insure that the particular container is properly fed thereto for cutting. To further understand the problems involved in such a task, it is important to understand other features of the reverse vending machine 14. Although not shown in detail, the reverse vending machine 14 generally includes an access door (at the right side of the machine as shown in FIG. 2) in which the customer will deposit one bottle 20 from the group of plastic bottles 10, 11, 12 or 13. The bottle 20 must be deposited with the top upwardly or downwardly depending on the location of the UPC Code. The plastic bottle, whatever size it may be, is placed in a trough which is positioned generally vertically inside the opening. When the access door is closed, the bottle is caused to rotate by friction wheels mounted on the trough to produce the proper alignment and movement of the bottle required to electronically read the UPC Code. The reverse vending machine 14 is so configured to provide a proper accounting of the particular plastic bottles disposed therein in order to verify which bottle company will provide the redemption money for the grocery store.

After the UPC Code is properly read, the trough is automatically reoriented to cause the bottle 20 to slide downwardly as shown in FIG. 2 toward the entrance of the first cutting section 16. Gravity alone will not insure that the plastic bottle 20 will be properly gripped by and cut in the first cutting section 16. Accordingly, each of the feeding shafts 38 is provided radially extending paddles thereon to rotate with the shafts and to provide positive feeding of the bottle 20 to the cutting wheels mounted on the cutting shafts 28, 30.

In order to demonstrate how the different sized plastic bottles can present different problems for the efficient operation of a feeding assist means, typical types of failures or delays are demonstrated in FIGS. ·3 through 5. In the prior art configuration of FIG. 3, the feeding assist device 42 includes a pair of radially extending paddles 44 for each feeding shaft 38. With the shafts 38 rotating in opposite directions but at the same speed, the paddles 44 are rotationally aligned to cause each paddle to pass closely by a corresponding paddle on the other shaft 38. The configuration of the feeding assist device 42 is similar to that disclosed in U.S. Ser. No. 742,999. Specifically, the extended edges of each paddle 44 has a plurality of teeth 45 thereon which were intended to assist in the proper gripping of the plastic bottles for advancement to the cutting wheels. However, it has been found that, periodically, a two liter bottle 12 can be caused to wrap itself about the paddles 44 of the shaft 38. When wrapped in such a manner, the plastic bottles 12 will not become dislodged and must actually be cut from the paddles 44. Such a procedure requires the reverse vending machine to be taken out of operation for a significant amount of time during which customers will not be able to redeem plastic bottles therein.

Figure 4:
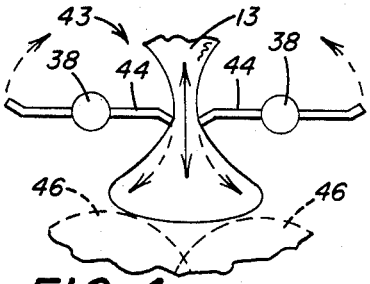
FIG. 4 PRIOR ART

A similar feeding assist device 43 is shown in FIG. 4 to demonstrate how three liter bottles 13 are periodically positioned in a manner which will not allow them to be properly gripped by the cutting teeth of the cutting wheels. Specifically, the three liter bottle 13 can be oriented with the base down and the sides thereof pushed inwardly. Such a bottle 13 is generally described as a "bobber" since it tends to bob upwardly and downwardly as the paddles 44 pass thereby without being properly forced downwardly. As seen, the bottom of the bottle 13 is located against the path 46 of the cutting teeth but in a manner which does not allow gripping by the cutting teeth. When the bottle 13 is so positioned in the feeding assist device 43, the sensing device mentioned hereinabove indicates that it has not been properly fed to the cutting wheels. A signal from the sensing device prevents any additional bottles from being deposited in the reverse vending machine. Again, store personnel would be required to enter the reverse vending machine for manual removal of the bottle 13 which would reuslt in a significant loss of use of the reverse vending machine.

Figure 5:
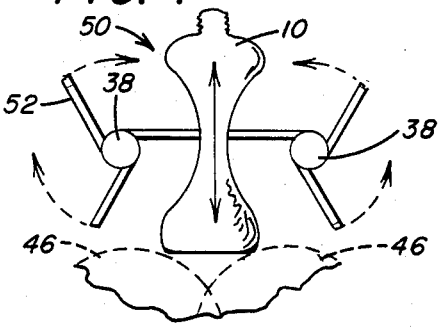
FIG. 5 PRIOR ART

Similarly, in FIG. 5, an alternative prior art feeding assist device 50 includes three evenly spaced paddles 52 on each feeding shaft 38. However, even with a simple configuration having an additional paddle extending from the shaft 38, there is no assurance that the bottles will be properly fed to be gripped by the cutting teeth as they travel along the path 46. Specifically, the sides of a one-half liter bottle 10 can be deflected between the paddles 52 of such a feeding device 50. Again the bottle 10 will act as a "bobber" with the bottom thereof not properly oriented to be gripped by the cutting teeth.

From any number of experimental feeding assist devices, it has been found that there are numerous paramaters which will not produce proper, continuous feeding. Proper feeding must include the numerous sizes of plastic bottles which may be deposited in a reverse vending machine or which may at some future date be required for use in such a reverse vending machine. If not properly gripped by the paddles of a feeding device, some bottles may become unintentionally positioned longitudinally in a parallel manner with the shafts 38 and simply rotate around the shafts between the paddles. If the shafts 38 are located too closely together, it would be impossible for the larger three liter bottles 13 to pass therebetween. On the other hand, if the shafts 38 are located too far apart, the smaller half liter plastic bottles 10 would not be properly gripped for feeding to the cutting wheels. A further complication exists since the plastic bottles may be directed to the feeding assist means either bottom first or top first which can affect how the cutting teeth initially grip the plastic bottle.

Figure 3:
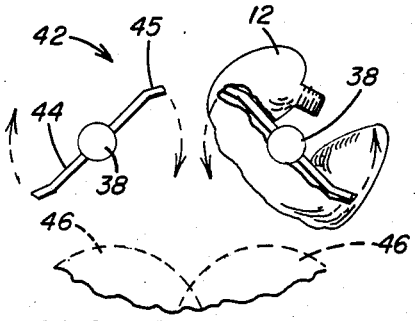
FIG. 3 PRIOR ART
FIGS. 3, 4 and 5 are fragmentary schematic views of prior art feeding assist devices demonstrating how failure to properly feed plastic bottles could result in failure to properly cut the bottles in a reverse vending machine.

In order to further demonstrate the premium which is placed in the use of a reverse vending machine on the proper feeding of the containers for cutting, a further explanation of the sensing devices and additional operations in the machine should be included. Generally, as mentioned above, after a bottle has been placed in the trough and is properly electronically read, sensing devices indicate the presence of the bottle in the trough until it is oriented downwardly for cutting. Once the bottle leaves the trough and is properly accepted for cutting, the sensors will indicate that the bottle is clear and the trough will be returned for the acceptance of a new container. On the other hand, if the container is wrapped about the paddle configuration as shown in FIG. 3, or becomes a "bobber" as shown in FIGS. 4 and 5, the sensors indicate that the bottle is still present above the cutters and has not been properly cut into the desired pieces. When the sensors indicate that the container has not been properly fed, the motor driving the cutters and feeding device stops and is operated in reverse for a short period of time. After that period of time, the machine is again operated in the forward direction and the sensor is again employed to determine if the container is properly fed. If not properly fed the stopping and reverse action is repeated. Failure to clear the container the second time will again cause the motor to be stopped and reversed. If after the third time the bottle will not clear the feeding device for proper cutting, the motor will be stopped and indicator lights on the front panel of the reverse vending machine will indicated a "failure" which will require that the customer call the store manager or the like for assistance. Although the cutting sections 16 and 18 will tend to properly cut containers which are fed thereto, the reverse vending machine also includes sensors to indicate if there is an overload or stopping of the cutters thereof which could damage the sections 16, 18. Again, upon sensing some problem with the cutting sections, the motors will be stopped and reversed for a short period of time. From this description of the attempts which are made to insure proper feeding, it can be seen that a "failure" must be quite serious for the machine to be placed out of service. In other words, the bottles which become wrapped about the paddles or the containers which become "bobbers" are significantly improperly positioned for feeding so that stopping and reversal of the machine still will not result in proper feeding for cutting. Clearly, any "failure" is unacceptable and the present invention is intended to insure that there are no "failures". On the other hand, with the proper container feeding device of the present invention, it is also expected that feeding wil be improved to the extent that the sensing devices will be much less likely to ever require stopping and reversal of the motors for clearing and eventual cutting. Even though such problems would not be classified as a "failure" they are not desired and are preferrably eliminated so that there is no delay in operation to prevent customers from continuously feeding containers thereto for redemption. In other words, customer satisfaction is important even if the problems which occur do not actually cause the machine to be taken out of service.

Figure 6:
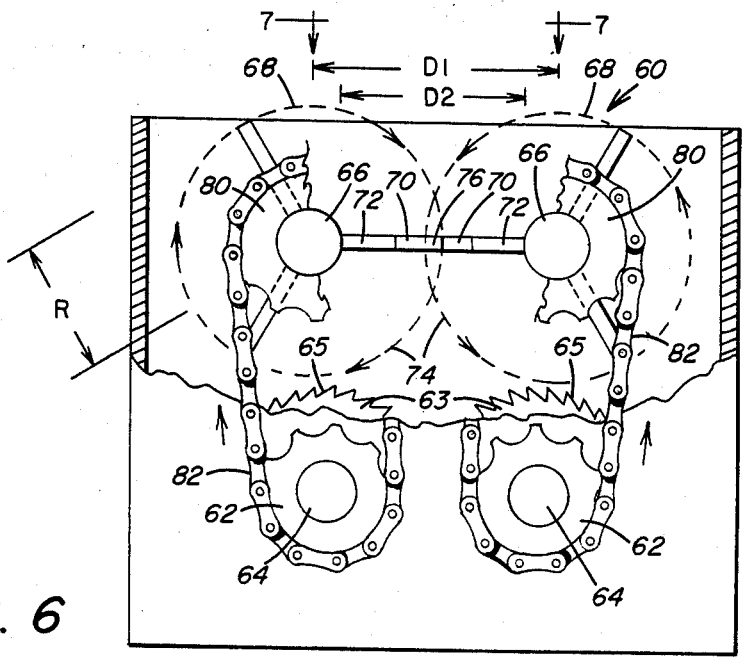
FIG. 6 is a fragmentary, sectional view of the preferred feeding assist device including various feature of the invention.
Figure 7:
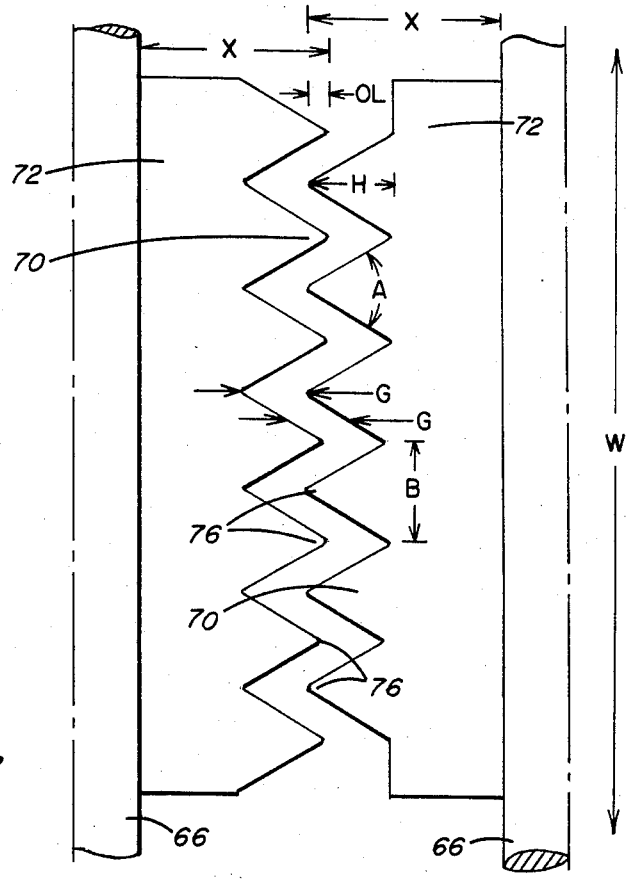
FIG. 7 is a view of the preferred feeding device as seen along line 7—7 of FIG. 6.

To eliminate these and other problems with properly feeding the various sizes of plastic bottles to the cutting section 16, a preferred feeding device 60 as shown in FIGS. 6 and 7 has been provided. Throughout the description of the preferred container feeding device 60, repeated reference will be made to various specific dimensions and relative dimensions which significantly contribute to the proper operation thereof. While some of the dimensions are more important than others, it should be clear from the problems presented hereinabove that "failure" to feed any one of the numerous sizes of plastic bottles could result in a substantial delay in the operation of a reverse vending machine. Accordingly, the particular combination of features and relative dimensions which will insure that all of the various sizes of plastic bottles are fed to the cutting section without delay or "failure" is extremely important.

As seen in FIGS. 6 and 7, the preferred container feeding device 60 is driven in a manner similar to that shown in the prior art configuration of FIG. 2. The motor drives one of the cutting shafts 64 which is geared to and drives the other cutting shaft 64. The preferred cutting wheels 63 are keyed on each shaft 64 for rotation therewith. As mentioned above, adjacent cutting wheels 63 on one cutting shaft 64 are separated by a cutting wheel 63 on the other cutting shaft 64. The overlapping cutting wheel 63 are capable of cooperating to grip containers which are properly fed thereto. The preferred cutting teeth 65 on the cutting wheel 63 are inclined toward the direction of rotation as shown in FIG. 6 to insure a proper gripping of the containers is accomplished. One the container is gripped by the cutting teeth 65, it is drawn between the rotating cutting wheels 63 to be cut into elongated strips thereby.

To provide basic rotation to the feeding shaft 66, a drive sprocket 62 is mounted on the end of each of the cutting shafts 64 for rotation therewith. Each drive sprocket 62 is encircled by a chain 82 which in turn provides rotation to its respective feeding shaft 66 as it encircles a driven sprocket 80 on the end thereof. The relationships between the drive sprocket 62 and the driven sprocket 80 will be discussed in detail below.

The pair of parallel feeding shafts 66 are centrally disposed above and parallel with the pair of cutting shafts 64. The predetermined distance D1 between the center line of the feeding shafts 66 is preferrably about five inches. Because each of the preferred feeding shafts 66 has a diameter of $1\frac{1}{4}$ inches, the actual distance D2 between the feeding shafts 66 themselves is only about $3\frac{3}{4}$ inches. With such a small distance D2 between the feeding shafts 66, it would not initially appear that the preferred container feeding device 60 would be appropriate for the feeding of two liter plastic bottles 12 or three liter plastic bottles 13 which respectively have widths of $4\frac{1}{2}$ inches and 5 inches. However, the preferred paddle configuration to be described hereinbelow is capable of properly gripping the bottles 12, 13 to force them between the feeding shafts 66 for proper delivery to the cutting teeth 65. Although the distance relative the width in this situation is not a problem, one might wonder why the feeding shafts 66 are not simply placed further apart. However, it is advantageous for the paths 68 of the teeth 70 of each paddle 72 to pass as closely as possible downwardly toward the cutting wheels 63 as shown at 74. Placing the feeding shafts 66 further apart and therefore further above the cutting wheels 63 would increase the space at 74 between the paths 68 of the teeth 70. Additionally, this would increase the gap above the cutting teeth 65 of the cutting wheels 63 and decrease the likelihood that the cutting teeth 65 would grip the container after it is fed thereto. This feature is particularly important for the smaller plastic bottles 10, 11 and demonstrates how the preferred container feeding device 60 incorporates critical features to accommodate larger plastic bottles while still being capable of accommodating the smaller plastic bottles.

In fact, in the preferred configuration, the most effective tooth path 68 at the critical area 74 is primarily obtained by the tooth design which allows a radial overlap OL between the corresponding paddles 72 as they pass closely by one another. The use of the overlapping tooth configuration tends to eliminate the problems demonstrated in FIGS. 4 and 5 where the space between the ends of corresponding paddles is too great and results in a significant number of "bobbers" when attempting to feed the smaller plastic bottles 10, 11.

Clearly, solving one problem which may interfere with the reliability of the container feeding device can lead to other, different problems which could prevent its effective operation. Accordingly, it is perhaps best to fully describe the preferred dimensions and parameters of the container feeding device 60 prior to discussing other problems which could be created if the container feeding device were not properly configured.

Each of the preferred feeding shafts 66 includes three radially extending, evenly spaced paddles 72 fixedly mounted thereon. Each of the paddles 72 is formed of sheet steel material having a thickness of about $\frac{1}{4}$ inches and has a length X from the feeding shaft 66 of about 2 inches. The overall width W of the paddles 72 is preferrable 77/16 inches which corresponds to width of the array of cutting wheels 63 of the first cutting section 16. Consequently, the radial length R of each of the paddles 72 is about $2\frac{5}{8}$ inches. Clearly, with such a radial length R and the above mentioned distance D1 of about 5 inches between the feeding shafts, there would be an overlap OL of the corresponding paddles 72. Since the feeding shafts 66 rotate at the same speed and are rotationally aligned to cause each of the paddles 72 on one feeding shaft 66 to generally be in a common plane with a corresponding paddle 72 on the other feeding shaft 66 when passing closely thereby, it might appear that there is contact between the paddles because of the overlap. The preferred means for providing the overlap OL without producing contact between the paddles 72 is to include a tooth configuration at the extended end of each of the paddles 72. Although one of the preferred paddles 72 has one less tooth 70 than the other corresponding paddle 72, the significant feature includes alignment of the tips 76 of each of the gripping teeth 70 so that they extend between the gripping teeth 70 of the corresponding paddle 72 on the other feeding shaft 66. As a result, the radial overlap OL of each paddle 72 with its corresponding paddle 72 occurs only at the tips 76 when the paddles 72 are in the common plane as they pass closely by each other. It should be noted that the same general configuration including a deliberate misalignment of the tips 76 of each of the gripping teeth 70 with the gripping teeth of the corresponding paddle 72 on the other feeding shaft 66 occurs between the tips 76 and the corresponding cutting shaft 64. In other words, the tips 76 are aligned generally between the cutting wheels 63 to insure that there is not interference between the gripping teeth 70 and the cutting wheels 63 of the corresponding cutting shaft 64 during the rotation of each.

While a number of teeth configurations may be acceptable, it has been found that gripping teeth 70 having a triangular shape with a predetermined height H between a base B and its respective tip is preferred. In fact, the preferred triangular shape is generally in the form of an equalaterial triangle with an angle A at the tip of about 60 degrees. A preferred base B of 11/16 inch and height H of 15/16 inch has been found to satisfactorily provide the preferred overlap OL of about ¼ inch. With the tips 76 evenly positioned between the teeth 70 of the corresponding paddle 72, the radial gap G between the edge of the gripping teeth 70 on each of the paddles 72 and the edge of the gripping teeth 70 on the corresponding paddle 72 along the entire width W of the paddles 72 is 11/16 inch.

At first glance, these dimensions may appear to be of interest but simply a matter of design choice. However, they are considered to be very significant because of other problems which can be created when attempting to properly feed the above described containers to a cutting section. It is the primary purpose of the preferred container feeding device 60 to grip the containers for advancement toward the cutting section but, when gripping the containers, they should not be cut or pierced. For example, the use of two paddles 44 for the container feeding device 42 of FIG. 3 resulted in sufficient piercing and cutting of the bottle 12 to prevent its being properly advanced toward the cutting wheels. While the preferred use of three paddles may appear to eliminate such a problem, it has also been found that the design of the teeth configuration on the paddles can effect the type of gripping which occurs. Initially, when forming the paddles 72 and teeth 70 thereof from sheet material, care is taken to insure than none of the edges of the teeth 70 are sharp or jagged which would have a tendancy to cut or puncture the bottles. The side edges of the teeth 70 are sufficiently dull to cause the teeth 70 to bend and grip the walls of the containers without cutting them. However, even with the edges being dull, puncturing or piercing could result if the proper dimensions were not chosen. For example, if the thickness of the sheet steel material was sufficiently less than ¼ inch while the overlap OL were greater than ¼ inch, the thinner, longer tips of the teeth could pierce the plastic bottles. Accordingly, in the preferred configuration the overlap OL of the gripping teeth 70 is about equal to the thickness of the sheet steel material.

Similarly, if the angle A were acute and significantly less than the preferred 60 degrees, piercing could result. On the other hand, having too great an angle A would not grip the plastic bottles as desired and could result in "bobbers". By choosing the proper angle A for the tip 76 of the teeth 70 and the proper base B and height H thereof, the radial gap G between the edges of the gripping teeth 70 along the entire width W of the paddles 72 is between 60 percent and 70 percent of the height H of the teeth 70. Providing such a radial gap G relative to the teeth 70 allows sufficient space for the plastic sheet material of the bottle to be located without producing the undesired cutting or puncturing mentioned above.

While the preferred tooth configuration is intended to properly grip without piercing the containers, the description provided hereinabove assumes that the paddles 72 are properly aligned in the common plane to entrap the containers therebetween. However, it has been found that if the angular orientation of the shafts is not properly aligned or if the tips of the paddles 72 are separated one from the other by as much as ¼ inches, proper gripping may not occur. If during the rotation of the correspsonding paddles 72 one slightly preceeds the other, the container can be tilted sideways and crushed in a manner which will not properly present it to the cutting wheels 63. Accordingly, to insure cooperation between the corresponding paddles 72, the preferred container feeding device 60 includes the paddles 72 being aligned within ⅛ inches of each other as they respectively rotate with their feeding shafts 66.

Selecting appropriate dimension for properly aligned paddles 72 and teeth 70 provides a preferred overlap OL and radial gap G for gripping but does not necessarily insure that the container will be properly directed to the cutting teeth 65 for proper gripping thereby. While the cutting teeth 65 serve the added purpose of gripping the containers prior to continued rotation and cutting, the actual speed of the containers as they enter between the cutting wheels 63 can be significant to insure that a proper grip and cut results. One might assume that almost any feeding speed would be adequate since rapid feeding would surely result in the cutting teeth gripping the container. However, if the speed of the feeding paddles is too great, the container may be crushed against the cutting wheels to further complicate gripping and cutting thereby. On the other hand, if the containers are fed too slowly to the cutting wheels, the cutting wheels may grip the container and tend to tear or rip it from the grip of the feeding paddles. Sufficient gripping or pulling by the cutting wheels could even damage the feeding paddles or cut or pierce the plastic material in the manner described above which could interfere with proper feeding for cutting.

As shown in FIG. 6, the diameter of the preferred cutting wheels 63 is about 4¾ inches. This size of cutting wheels 63 will properly grip and cut containers presented thereto if the cutting shafts 64 are caused to rotate by the motor 26 through a reduction gear at a rotational speed of 34.65 RPM. As a result, the circumfrential speed of the cutting teeth 65 is about 43.08 feet per minute (FPM). Because the radial length R of the preferred feeding paddels 72 is about 2⅝ inches, the effective diameter of the feeding teeth path 68 is 5¼ inches. If the rotational speed of the cutting shaft 64 were identical to the rotational speed of the feeding shaft 66, the circumfrential speed of the feeding teeth 70 would be significantly greater than the circumfrential speed of the cutting teeth 65. Accordingly, the drive sprocket 62 on the cutting shaft 64 has 11 sprockets while the driven sprocket 80 on the feeding shaft 66 is provided with 13 sprockets. Consequently, the rotation speed of the feeding shaft 66 is eleven-thirteenths of the rotational speed of the cutting shaft 64 as it drives the feeding shaft 66 through the chain 82. Although this results in a preferred ratio of the rotational speeds of the shafts 66,64 of about 0.846, it is believed that satisfactory feeding will occur as long as the rotational speed of the feeding shaft 66 is less than the rotational speed of the cutting shaft 64 while still being greater than about three-fourths of the rotational speed of the cutting shaft 64.

From the above described dimensions, the circumfrential speed of the tips of the gripping teeth can be calculated to be 40.3 (FPM). Accordingly, the ratio of the circumfrential speed of the tips of the gripping teeth 70 and the circumfrential speed of the cutting teeth 65 of the cutting wheels 63 is preferrably about 0.93. However, through experimentation it is believed that a ratio of the circumfrential speed of the tips of the gripping teeth 70 and the circumfrential speed of the cutting teeth 65 would be acceptable if it were between 0.85 and 1.

Before and during the development of the preferred container feeding device 60, numerous experiments were conducted with various container feeding devices similiar to those shown in the prior art and others having characteristics and features which resulted in feeding problems of the types described above. These experiments were conducted in a shop installation with only limited runs and without the use of the automatic motor reversing feature incorporated in the reverse vending machine. Nevertheless, any feeding problems were considered significant and indicative of possible "failures" in the field. In the experiments which included all of the sizes of plastic bottles, it was common to experience a feeding problem when as few as 20 containers or as many as 900 containers were introduced for cutting.

When similiar experiments were conducted using the preferred feeding device 60, almost no problems were experienced and the design was considered so efficient that it was incorporated in the reverse vending machine for field testing. After months of operations it has been determined that only 3 to 4 "failures" occur for about every 50,000 plastic bottles fed to a machine. The experiments included over 400 reverse vending machines each of which has accepted as many as 20,000 plastic bottles a month. Such "failures" requiring entering and clearing by store personnel only once or twice a month for such an actively used machine is clear proof of the reliability and efficiency of the preferred feeding device 60.

Nevertheless, from the description provided above, it should be clear that various alterations can be made to the preferred feeding device without departing from the scope of the invention as claimed.

I claim:

1. An improved container feeding device for a container cutting machine of the type which is capable of cutting any one of numerous sizes of plastic bottles and metal cans, said machine including a cutting section having a pair of parallel cutting shafts mounted for rotation in opposite directions, each of said cutting shafts supporting a plurality of cutting wheels keyed for rotation therewith, each of said cutting wheels on one of said cutting shafts being axially separated from axially adjacent said cutting wheels thereon by one of said cutting wheels on the other of said cutting shafts extending therebetween, and each said cutting wheel having plurality of cutting teeth thereon, said improvement comprising:

a pair of parallel feeding shafts centrally disposed above said pair of said cutting shafts and parallel therewith, said feeding shafts being a predetermined distance apart;

each of said feeding shafts including three radially extending, evenly spaced paddles fixedly mounted thereon, each of said feeding shafts and said paddles thereon rotating in the same direction as its adjacent said cutting shaft;

each said paddle having an extended end including a plurality of gripping teeth, said paddle having a predetermined radial length from a center of said feeding shaft to a tip of said gripping teeth;

said feeding shafts rotating at the same speed and being rotationally aligned to cause each said paddle on one said feeding shaft to generally lie within a common plane with a correpsonding said paddle on the other feeding shaft when passing closely thereby;

said each paddle on said feeding shaft having said tips of said gripping teeth thereof extending between said gripping teeth of said corresponding paddle on said other feeding shaft to produce a radial overlap of said each paddle with said corresponding paddle when in said common plane;

said predetermined radial length of said paddle being greater than one half of said predetermined distance; and said extended ends of said each paddle and said corresponding paddle cooperating during rotation prior to, through and after leaning said common plane to grip said container therebetween for pushing toward said cutting wheels.

2. The improved container feeding device as set forth in claim 1, wherein said gripping teeth of said paddles have a triangular shape to include a predetermined height between a base of said gripping teeth and said tip.

3. The improved container feeding device as set forth in claim 2, wherein a length of said radial overlap is between a one-fourth and one-third of said predetermined height.

4. The improved container feeding device as set forth in claim 2, wherein said triangular shape is generally in the form of an equalateral triangle with an angle at said tip of about sixty degrees.

5. The improved container feeding device as set forth in claim 4, including a radial gap between an edge of said gripping teeth on said each paddle and an edge of said gripping teeth on said corresponding paddle along an entire width of said paddles which said radial gap is between sixty percent and seventy percent of said height of said teeth.

6. The improved container feeding device as set forth in claim 2, wherein said paddles are formed of sheet steel material.

7. The improved container feeding device as set forth in claim 6, wherein said edges of said gripping teeth are dull to cause said gripping teeth to bend and grip said containers without cutting said containers.

8. The improved container feeding device as set forth in claim 6, wherein said height of said gripping teeth is about three and one-half to about four times as great as a thickness of said sheet steel material.

9. The improved container feeding device as set forth in claim 6, wherein said length of said radial overlap of said gripping teeth is about equal to a thickness of said sheet steel material.

10. The improved container feeding device as set forth in claim 9, wherein said thickness of said sheet steel material is about one-fourth of an inch.

11. The improved container feeding device as set forth in claim 1, wherein a rotational speed of said feeding shafts is less than a rotational speed of said cutting shafts.

12. The improved container feeding device as set forth in claim 11, wherein said rotational speed of said feeding shafts is greater than about three-fourths of said rotational speed of said cutting shafts.

13. The improved container feeding device as set forth in claim 11, wherein a ratio of a circumferential speed of said tips of said gripping teeth and a cimrumferential speed of said cutting teeth of said cutting wheels is between 0.85 and 1.

14. The improved container feeding device as set forth in claim 13, wherein said circumferential speed of said tips is about forty feet per minute.

15. The improved container feeding device as set forth in claim 1, wherein said tips of said gripping teeth on said each paddle and said corresponding paddle are within one-fourth of an inch along the circumferential paths of each as said paddles generally lie within said common plane.

* * * * *